US007884769B2

(12) United States Patent
Boyle

(10) Patent No.: US 7,884,769 B2
(45) Date of Patent: Feb. 8, 2011

(54) PLANAR ANTENNA ASSEMBLY WITH IMPEDANCE MATCHING AND REDUCED USER INTERACTION FOR A RF COMMUNICATION EQUIPMENT

(75) Inventor: Kevin Boyle, Horsham (GB)

(73) Assignee: Epcos AG, Munich (DE)

( * ) Notice: Subject to any disclaimer, the term of this patent is extended or adjusted under 35 U.S.C. 154(b) by 306 days.

(21) Appl. No.: 11/915,818

(22) PCT Filed: May 23, 2006

(86) PCT No.: PCT/IB2006/051644

§ 371 (c)(1),
(2), (4) Date: Jul. 29, 2008

(87) PCT Pub. No.: WO2006/129239

PCT Pub. Date: Dec. 7, 2006

(65) Prior Publication Data

US 2009/0213015 A1 Aug. 27, 2009

(30) Foreign Application Priority Data

May 31, 2005 (EP) ..... 05300434

(51) Int. Cl.
*H01Q 1/24* (2006.01)
*H01Q 1/38* (2006.01)

(52) U.S. Cl. ..... 343/702; 343/700 MS; 343/846; 343/829

(58) Field of Classification Search ..... None
See application file for complete search history.

(56) References Cited

U.S. PATENT DOCUMENTS 6,407,710 B2 * 6/2002 Keilen et al. ..... 343/702
6,662,028 B1 12/2003 Hayes et al.
6,850,195 B2 2/2005 Onaka et al.
7,026,999 B2 4/2006 Umehara et al.
7,199,757 B2 * 4/2007 Tung ..... 343/700 MS
7,215,283 B2 * 5/2007 Boyle ..... 343/700 MS
7,671,808 B2 * 3/2010 Boyle ..... 343/702

(Continued)

FOREIGN PATENT DOCUMENTS

EP 0818847 A2 1/1998

(Continued)

*Primary Examiner*—Trinh V Dinh
(74) *Attorney, Agent, or Firm*—Slater & Matsil, L.L.P.

(57) ABSTRACT

A planar antenna assembly (AA), for an RF communication module, comprises i) a ground plane (GP) and a feeding circuit (FC) defined on a lace of a printed circuit board (PCB), ii) a feed tab (FT1) and a first shorting tab (ST1) coupled to the feeding circuit (FC) and the ground plane (GP) respectively, and iii) a radiating element (RE) comprising a first part (P1) connected to the feed tab (FT) and first shorting tab (ST1), located in a first plane approximately perpendicular to the ground plane (GP) and in which a slot (SO), comprising opened (OE) and closed (CE) ends, is defined, and a second part (P2) extending approximately perpendicularly from the first part (P1) to be located in a second plane lacing and approximately parallel to the ground plane (GP). The feed tab (FT) and first shorting tab (ST1) are parallel and close to each other and connected to the first part (P1) at a chosen place located at a chosen distance away from the slot opened end (OE) in order to define a chosen input impedance.

19 Claims, 4 Drawing Sheets

U.S. PATENT DOCUMENTS

| | | | |
|---|---|---|---|
| 2003/0174092 | A1 | 9/2003 | Sullivan et al. |
| 2004/0066334 | A1 | 4/2004 | Fang et al. |
| 2005/0128151 | A1 | 6/2005 | Kwak et al. |

FOREIGN PATENT DOCUMENTS

| | | | |
|---|---|---|---|
| EP | 1079463 | A2 | 2/2001 |
| EP | 1502322 | B1 | 6/2006 |
| JP | 10-028013 | A | 1/1998 |
| JP | 2004-128605 | A | 4/2004 |
| JP | 2004-201278 | A | 7/2004 |
| JP | 2004-228982 | A | 8/2004 |
| JP | 2004-253942 | A | 9/2004 |
| WO | 0180354 | A1 | 10/2001 |
| WO | 0231921 | A2 | 4/2002 |
| WO | 2005006493 | A1 | 1/2005 |
| WO | 2005018045 | A1 | 2/2005 |

* cited by examiner

PLANAR ANTENNA ASSEMBLY WITH IMPEDANCE MATCHING AND REDUCED USER INTERACTION FOR A RF COMMUNICATION EQUIPMENT

RELATED APPLICATIONS

This application is the U.S. National Phase under 35 U.S.C. §371 of International Application No. PCT/IB06/51644 filed May 23, 2006, which in turn claims the benefit of European Application No. 05300434.7, filed on May 31, 2005, the disclosures of which Applications are incorporated by reference herein.

FIELD OF THE INVENTION

The present invention relates to the domain of radiofrequency (RF) communication equipment, and more particularly to the planar antennas comprised in such RF communication equipment.

By "communication equipment" meant here any equipment, mobile or not, adapted to establish single or multi standard radio communications with mobile (or cellular) and/or WLAN and/or positioning networks, and notably a mobile phone (for instance a GSM/GPRS, UMTS or WiMax mobile phone), a personal digital assistant (PDA), a laptop, a base station (for instance a Node B or a BTS), a satellite positioning device (for instance a GPS one), or more generally an RF communication module.

Because of the miniaturization of RF communication equipment or modules, the place dedicated to the antenna assembly becomes more and more limited. For this reason it has been proposed to use planar antenna(s) (assemblies), for instance of the PIFA (Planar Inverted F Antenna) type.

BACKGROUND OF THE INVENTION

Such a planar antenna assembly usually comprises i) a ground plane and a feeding circuit defined on a face of a printed circuit board, ii) feed and shorting tabs coupled to the feeding circuit and the ground plane respectively, and iii) a radiating element connected to the feed and shorting tabs and in which a slot (comprising opened and closed ends) is defined in a plane parallel to the ground plane. An example of such a planar antenna assembly is notably disclosed in patent document EP 1502322.

This kind of antenna assembly is advantageous not only because of its limited bulkiness but also because it may allow multi frequency working (and multi-standard working) when it is connected to a switching circuit. Unfortunately, in this kind of antenna assembly the input impedance varies with the operating frequency. Therefore it becomes difficult to match the antenna assembly to the commonly used 50 ohms impedance of the RF communication equipment or module over a wide frequency range or large number of frequency bands. Moreover, in equipment such as mobile phones, the slot is located in a plane parallel to the front and back covers (defining the casing) in an area where the user's hand interacts with it, causing detuning and degradation of the radio performance.

SUMMARY OF THE INVENTION

So the object of the present invention is to improve the situation.

For this purpose, it provides a planar antenna assembly, for an RF communication module (or equipment), comprising:

- a ground plane and a feeding circuit defined on a face of a printed circuit board,
- a feed tab and a first shorting tab coupled to the feeding circuit and the ground plane respectively, and
- a radiating element connected to the feed tab and first shorting tab and in which a slot (comprising opened and closed ends) is defined This planar antenna assembly is characterized in that its radiating element comprises:

- a first part located in a first plane approximately perpendicular to the ground plane and in which the slot is defined, the feed tab and first shorting tab being parallel and close to each other and connected to the first part at a chosen place located at a chosen distance away from the slot opened end in order to define a chosen input impedance, and
- a second part extending approximately perpendicularly to the first part to be located in a second plane facing and approximately parallel to the ground plane.

In other words the invention proposes to locate the slot in a plane approximately perpendicular to the front and back covers where it is unlikely to suffer from user interaction since the user rarely puts its fingers over the top cover part of its RF communication equipment. This new slot location allows to space the feed tab away from the slot opened end and then to increase the input current which in turn lowers the input impedance, particularly at high frequencies.

The planar antenna assembly according to the invention may include additional characteristics considered separately or combined, and notably:

- the chosen place of the feed tab may be located approximately equidistant from the opened and closed ends;
- it may comprise a switching circuit mounted on the printed circuit board, connected to the first part, at the level of the slot opened end, through an auxiliary tab, and arranged to be placed in a chosen one of at least two different states allowing radio communications in at least two different operating frequency bands respectively;
  - the switching circuit may comprise MEMS ("Micro ElectroMechanical Systems") devices;
  - it may comprise a second shorting tab parallel to the auxiliary tab and connected to the radiating element first part and to the ground plane at the level of the slot opened end;
- its feeding circuit may comprise MEMS devices;
- the slot may have a rectangular shape;
- it may define a planar inverted antenna assembly.

The invention also provides an RF communication module provided with a planar antenna assembly such as the one introduced above. Such an RF communication module may equip RF communication equipment.

The invention further provides a RF communication equipment provided with a planar antenna assembly such as the one above introduced.

BRIEF DESCRIPTION OF THE DRAWINGS

Other features and advantages of the invention will become apparent on examining the detailed specifications hereafter and the appended drawings, wherein.

The appended drawings may not only serve to complete the invention, but also to contribute to its definition, if need be.

DESCRIPTION OF PREFERRED EMBODIMENTS

Figure 1:
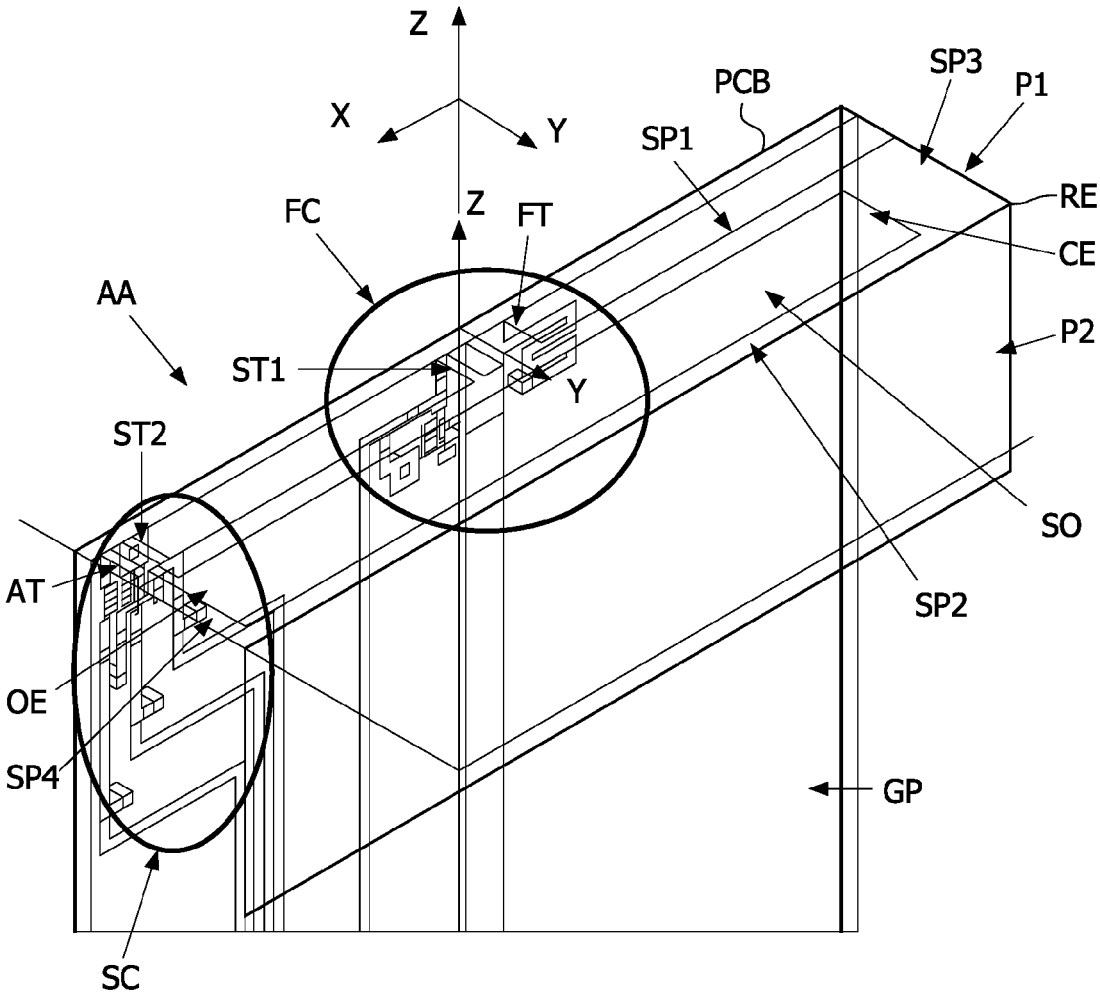
FIG. 1 schematically illustrates in a perspective view an example of embodiment of a planar antenna assembly according to the invention, FIG. 2 schematically illustrates, in details and in a plan view, examples of embodiment of a feeding circuit and a switching circuit for the planar antenna assembly illustrated in FIG. 1.

Reference is initially made to FIG. 1 to briefly describe an example of embodiment of a planar antenna assembly AA according to the invention.

In the following description it will be considered that the planar antenna assembly AA is intended for RF communication equipment such as a mobile phone, for instance a multi-standard one (AMPS/GSM and DCS and PCS and UMTS). But it is important to notice that the invention is not limited to this type of RF communication equipment or module.

Indeed the invention may apply to any RF communication equipment (or module), mobile or not, adapted to establish single or multi standard radio communications with mobile (or cellular) and/or WLAN and/or positioning networks. So it could also be a personal digital assistant (PDA), a laptop, a base station (for instance a Node B or a BTS), or a satellite positioning device (for instance a GPS one). Moreover, the invention is not limited to the above-cited multi-standard combination. It may apply to any multi-standard combination, and notably to a GSM/GPRS and/or UMTS/TD-SCDMA and/or WiMax and/or WLAN (e.g. 802.11a/b/g/n) and/or broadcast (e.g. DVB-H and DAB) and/or positioning (e.g. GPS) combination.

As illustrated in FIG. 1, a planar antenna assembly AA is mounted on a printed circuit board PCB, and more precisely on one of its faces, which is provided with a ground plane GP and at least a feeding circuit FC (which will be detailed later with reference to FIG. 2).

The planar antenna assembly AA comprises a feed tab (or pin) FT coupled to the feeding circuit FC and a first shorting tab ST1 coupled to the ground plane GP.

In the illustrated example, the first shorting tab ST1 is a switched shorting tab. So it is coupled to the ground plane GP through the feeding circuit FC.

The feed tab FT and the first shorting tab ST1 are parallel and close to each other and located in a first plane which is approximately perpendicular to the ground plane GP (or printed circuit board PCB). According to the frame defined by vectors X, Y and Z in FIG. 1, the first plane is parallel to a plane built with vectors X and Y, while the ground plane GP is located in a plane, which is parallel to a plane built with vectors X and Z.

The planar antenna assembly AA further comprises a radiating element RE comprising first P1 and second P2 parts approximately perpendicular in between. More precisely, the first part P1 is located in the first plane while the second part P2 is located in a second plane which is approximately parallel to the first one and then approximately parallel to the ground plane GP (or printed circuit board PCB) at a chosen distance thereof.

For instance and as illustrated, the first P1 and second P2 parts both have rectangular shapes, but this is not mandatory.

A slot SO is defined in the first part PI of the radiating element RE. For instance and as illustrated this slot has a rectangular shape, but this is not mandatory.

In the illustrated example, the slot SO is bounded by four sub parts of the radiating element first part P1. More precisely, the two longest sides of the slot SO are bounded by first SP1 and second SP2 "linear" sub parts, parallel to vector X, SP1 being connected to the feed tab FT and first shorting tab ST1 and SP2 which are perpendicularly extended by the radiating element second part P2. The two shortest sides of the slot SO are bounded by a third "rectangular" sub part SP3 connecting perpendicularly the first SP1 and second SP2 "linear" sub parts in between and a fourth "linear" sub part SP4 extending perpendicularly from the second "linear" sub part SP2 towards the printed circuit board PCB.

The second "linear" sub part SP2 being longer than the first "linear" sub part SP1, the slot SO comprises an opened end OE at the level of the fourth "linear" sub part SP4. The third "rectangular" sub part SP3 connecting the first SP1 and second SP2 "linear" sub parts in between, the slot SO comprises a closed end CE opposite its opened end OE (at the level of the third "rectangular" sub part SP3).

The respective sizes and shapes of the first to fourth sub parts of the first part P1 depends on the operating frequency band(s).

With such an arrangement, the slot SO is located in the first plane (XY). So, when the planar antenna assembly AA is mounted inside a casing of a mobile phone (or equipment), its printed circuit board PCB and radiating element second part P2 are sandwiched between the front and back casing covers and approximately parallel thereto, while the slot SO (defined in the radiating element first part P1) is located in a plan approximately parallel to the top cover part (which is generally approximately perpendicular to the front and back casing covers). Therefore, the slot SO is unlikely to suffer from user interaction since the user rarely puts his fingers over the top cover casing part of its mobile phone (or RF communication equipment).

The planar antenna assembly AA illustrated in FIG. 1 is a modified PIFA (Planar Inverted F Antenna). But the invention also applies to other types of planar or "monopole-like" antennas.

The slot location in a position perpendicular to the ground plane GP (or printed circuit board PCB) allows spacing of the feed tab FT away from its opened end OE. As known by the man skilled in the art, the input current is greatest near the closed end CE of the slot SO. Therefore the more the feed tab FT is moved away from the slot opened end OE, the greater the input current and the lower the input impedance (particularly at higher operational frequencies).

So, by choosing the place where the feed tab FT is connected to the first sub part SP1 of the radiating element first part P1, one may define the input impedance of the planar antenna assembly AA. Then it becomes possible to match the planar antenna assembly AA to the commonly used 50 ohms impedance of the mobile phone (or any other RF communication equipment or module). This in turn allows an easier multi-standard working of the mobile phone.

For instance, and as illustrated in FIG. 1, the feed tab FT may be connected to the first sub part SP1 of the radiating element first part P1 at a level (or position) which is approximately equidistant from the opened end OE and closed end of the slot SO.

In the example illustrated in FIG. 1, the planar antenna assembly AA comprises a switching circuit SC in order to be reconfigurable and then to allow a multi-standard working. This switching circuit SC is connected to the extremity of the fourth sub part SP4, which is opposite the second sub part SP2, through an auxiliary tab (or pin) AT.

Figure 2:
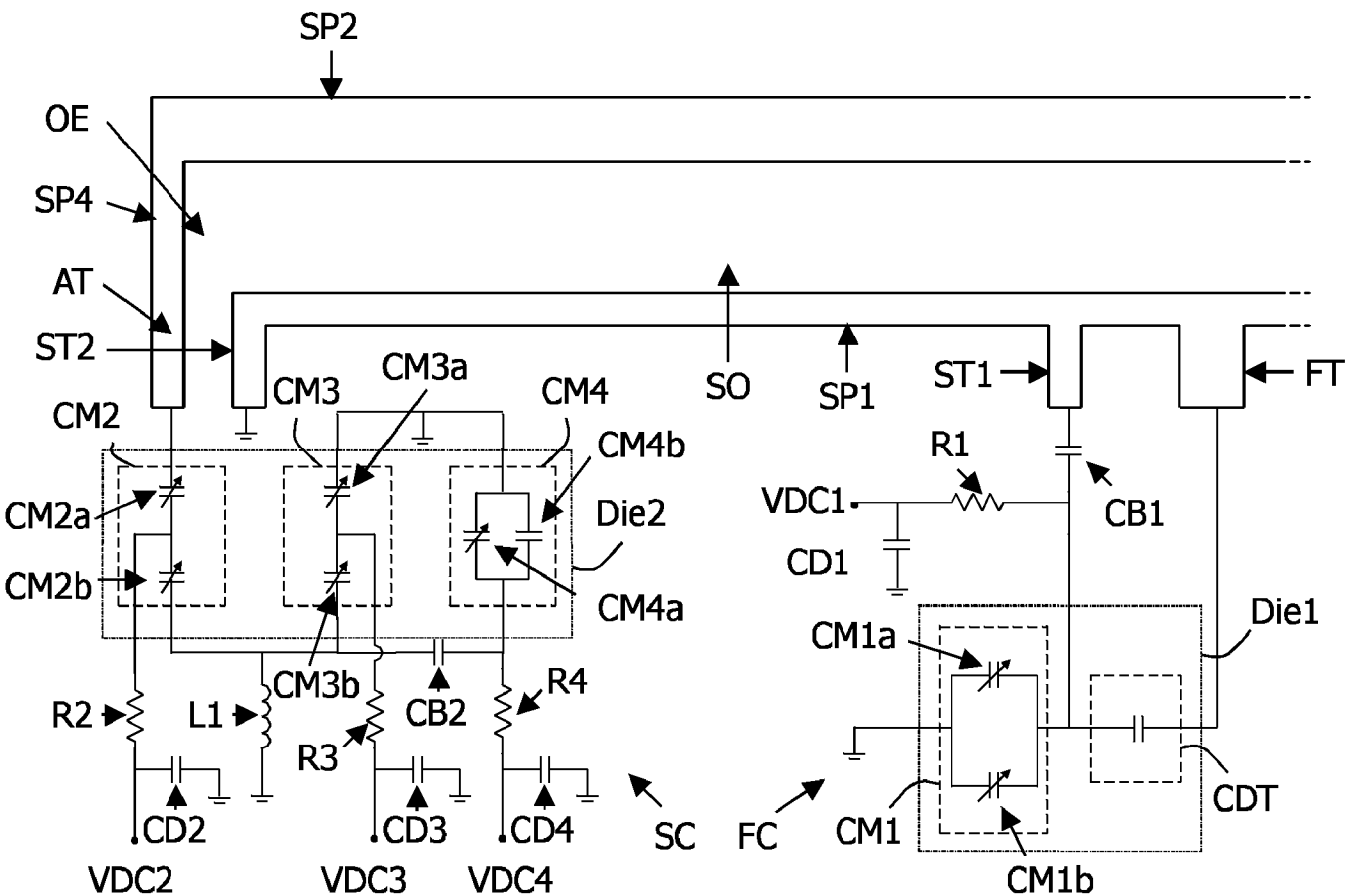

As is better illustrated in FIG. 2, the extremity of the first sub part SP1, which is opposite the third sub part SP3, is preferably connected to ground (of the ground plane GP) through a second shorting tab (or pin) ST2.

Non-limiting examples of embodiment of the feeding circuit FC and switching circuit SC, adapted to the planar antenna assembly AA illustrated in FIG. 1, are illustrated in FIG. 2.

In this example the feeding circuit FC comprises a bias circuit coupled to a control module Diel, which, in its turn, is coupled to the feed tab FT and to the shorting tab ST1.

For instance the bias circuit comprises two capacitors CD1 and CB1, with fixed capacitances, and a resistor R1.

The control module Diel comprises a feeding module CDT, essentially made of a capacitor, and a command module CM1, comprising two variable capacitors CM1a and CM1b mounted in parallel. For instance the two variable capacitors CM1a and CM1b are two MEMS devices, and more precisely, two MEMS switches. Each MEMS switch is a capacitor that can be switched between low and high capacitance states by means of a DC voltage VDC1. For instance the low capacitance (or "off state") occurs with no DC bias, while the high capacitance (or "on state") occurs with a significant DC bias VDC1 (approximately 40 volts), which is generated by the bias circuit of the feeding circuit FC. For instance the applied voltage VDC1 causes the top capacitor plate to move physically closer to the bottom capacitor plate, which causes a capacitance variation.

In this example the switching circuit FC comprises a control module Die2 coupled to the auxiliary tab AT and to three bias circuits.

The control module Die2 comprises three command modules CM2 to CM4 each dedicated to a frequency band and each comprising two variable capacitors CMia and CMib (with i=2 to 4). In the illustrated example the arrangement of the command module CM4 is different from one of the command modules CM1, CM2 and CM3 because the required capacitance ranges are different. For instance the two variable capacitors CMia and CMib are two MEMS devices, and more precisely two MEMS switches. Each MEMS switch is a capacitor that can be switched between low and high capacitance states by means of a DC voltage VDCi. For instance the low capacitance (or "off state") occurs with no DC bias, while the high capacitance (or "on state") occurs with a significant DC bias VDCi (approximately 40 volts), which is generated by the corresponding bias circuit. For instance the applied voltage VDCi causes the top capacitor plate to move physically closer to the bottom capacitor plate, which causes a capacitance variation.

For instance each bias circuit, dedicated to the generation of the DC bias VDCi of a command module CMi, comprises a capacitor CDi with a fixed capacitance, and a resistor Ri.

The three command modules CM2 to CM4 are connected to an LC circuit comprising a capacitor CB2, with a fixed capacitance, and an inductance L1. Moreover, in this illustrated example the control module Die2 is coupled to the auxiliary tab AT through a terminal of the command module CM2.

In the illustrated example the antenna mode switching is performed by varying the MEMS capacitance values between values Cmin and Cmax. An example of MEMS capacitance value variations is indicated in the table below (capacitance value unit is picofarad (pf)).

| | CDT | CM1a/b | CM2a/b | CM3a/b | CM4a/b |
|---|---|---|---|---|---|
| GSP/AMPS | 12 | 10 | 0.2 | 3.4 | 5.7 |
| DCS | 12 | 10 | 4 | 3.4 | 5.7 |
| PCS | 12 | 0.5 | 4 | 3.4 | 0.57 |
| UMTS | 12 | 0.5 | 4 | 0.17 | 0.57 |
| Cmin/Cmax | fixed | 20 | 20 | 20 | 10 |

In this Table Cmin/Cmax is the difference (in pF) between the minimum capacitance value (in the low state) and the maximum capacitance value (in the high state).

Simulated performances of a planar antenna assembly AA according to the invention, referenced to 50 ohms, are illustrated in the graphs of FIGS. 3 to 6.

Figure 3A:
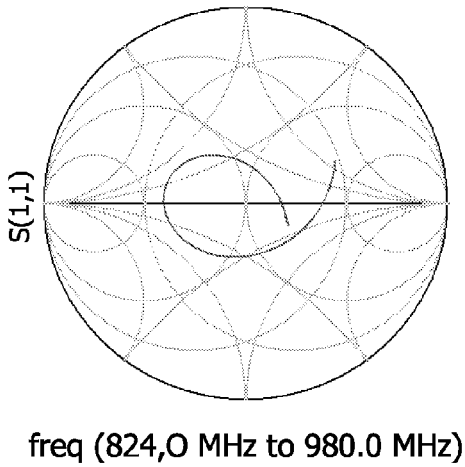
FIG. 3A is a Smith chart showing a simulated return loss $S_{11}$ (in dB) for the planar 55 antenna assembly illustrated in FIG. 1 in AMPS and GSM modes over the frequency range 824 MHz to 960 MHz.
Figure 3B:
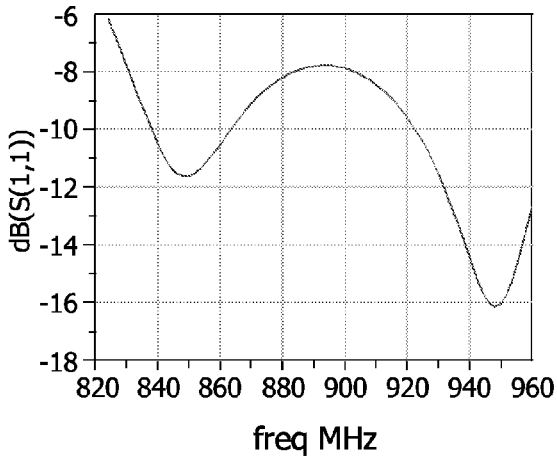
FIG. 3B is a graph of a simulated return loss $S_{11}$ (in dB) against frequency (in MHz) for the planar antenna assembly illustrated in FIG. 1 in AMPS and GSM modes.

FIGS. 3A and 3B show simulated performance of the planar antenna assembly AA when it works in AMPS and GSM modes over the frequency range 824 MHz to 960 MHz. More precisely, FIG. 3A is a Smith chart showing a simulated return loss $S_{11}$ (in dB), while FIG. 3B is a graph of the simulated return loss $S_{11}$ (in dB) against frequency (in MHz).

Figure 4A:
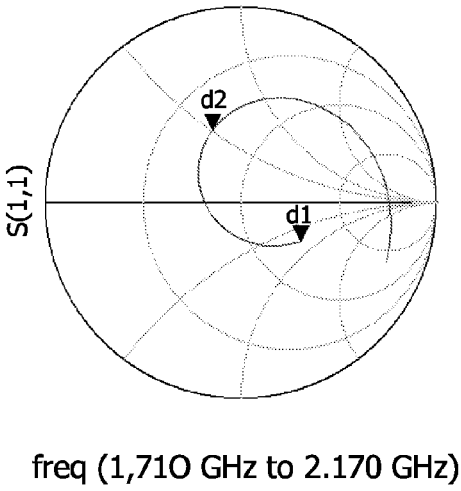
FIG. 4A is a Smith chart showing a simulated return loss $S_{11}$ (in dB) for the planar antenna assembly illustrated in FIG. 1 in DCS mode over the frequency range 1.710 GHz to 2.170 GHz.
Figure 4B:
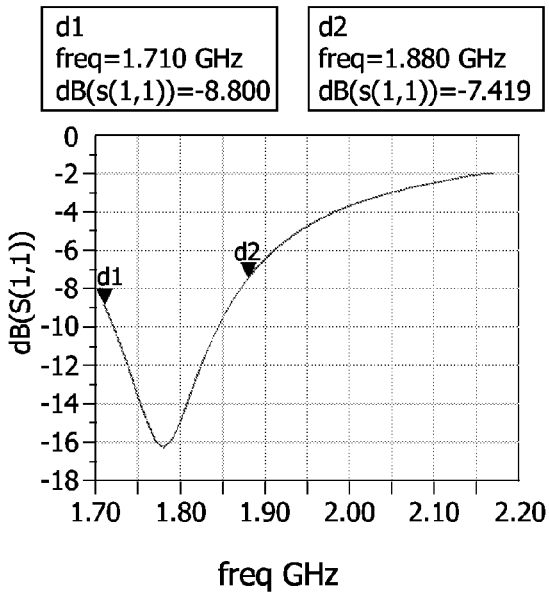
FIG. 4B is a graph of a simulated return loss $S_{11}$ (in dB) against frequency (in GHz) for the planar antenna assembly illustrated in FIG. 1 in DCS mode.

FIGS. 4A and 4B show simulated performance of the planar antenna assembly AA when it works in DCS mode over the frequency range 1.710 GHz to 2.170 GHz. More precisely, FIG. 4A is a Smith chart showing a simulated return loss $S_{11}$ (in dB), while FIG. 4B is a graph of the simulated return loss $S_{11}$ (in dB) against frequency (in GHz). Arrows d1 and d2 in FIG. 4A correspond to arrows d1 and d2 respectively in FIG. 4B.

Figure 5A:
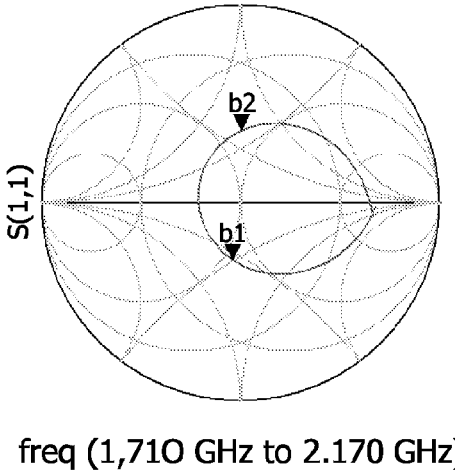
FIG. 5A is a Smith chart showing a simulated return loss $S_{11}$ (in dB) for the planar antenna assembly illustrated in FIG. 1 in PCS mode over the frequency range 1.710 GHz to 2.170 GHz.
Figure 5B:
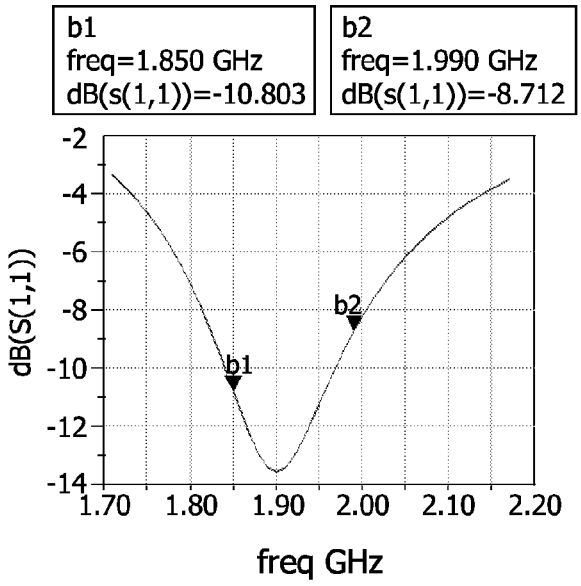
FIG. 5B is a graph of a simulated return loss $S_{11}$ (in dB) against frequency (in GHz) for the planar antenna assembly illustrated in FIG. 1 in PCS mode.

FIGS. 5A and 5B show simulated performance of the planar antenna assembly AA when it works in PCS mode over the frequency range 1.710 GHz to 2.170 GHz. More precisely, FIG. 5A is a Smith chart showing a simulated return loss $S_{11}$ (in dB), while FIG. 5B is a graph of the simulated return loss $S_{11}$ (in dB) against frequency (in GHz). Arrows b1 and b2 in FIG. 5A correspond to arrows b1 and b2 respectively in FIG. 5B.

Figure 6A:
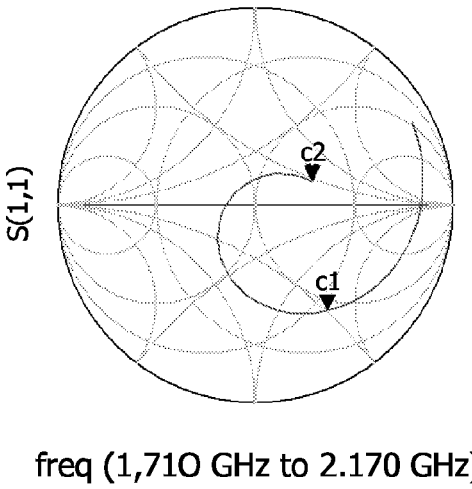
FIG. 6A is a Smith chart showing a simulated return loss $S_{11}$ (in dB) for the planar antenna assembly illustrated in FIG. 1 in UMTS mode over the frequency range 1.710 GHz to 2.170 GHz.
Figure 6B:
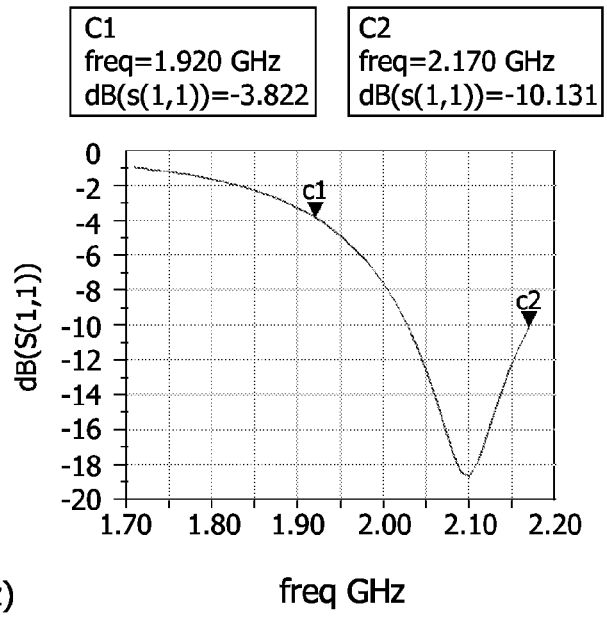
FIG. 6B is a graph of a simulated return loss $S_{11}$ (in dB) against frequency (in GHz) for the planar antenna assembly illustrated in FIG. 1 in UMTS mode.

FIGS. 6A and 6B show simulated performance of the planar antenna assembly AA when it works in UMTS mode over the frequency range 1.710 GHz to 2.170 GHz. More precisely, FIG. 6A is a Smith chart showing a simulated return loss $S_{11}$ (in dB), while FIG. 6B is a graph of the simulated return loss $S_{11}$ (in dB) against frequency (in GHz). Arrows c1 and c2 in FIG. 6A correspond to arrows c1 and c2 respectively in FIG. 6B.

The simulated performance indicates that five cellular frequency bands can be covered with a single planar antenna assembly AA according to the invention, which is approximately half the size of comparable conventional dual-band or tri-band antenna assembly.

The invention is not limited to the embodiments of planar antenna assembly AA and RF communication equipment or module described above, only as examples, but it encompasses all alternative embodiments which may be considered by one skilled in the art within the scope of the claims hereafter.

What is claimed is:

1. A planar antenna assembly for an RF communication module, comprising:

a ground plane and a feeding circuit defined onto a face of a printed circuit board, a feed tab and a first shorting tab respectively coupled to said feeding circuit and said ground plane, and a radiating element connected to said feed tab and first shorting tab and in which a slot, including opened and closed ends, is defined, wherein said radiating element includes a first part now located in a first plane approximately perpendicular to said ground plane and in which said slot is defined, the slot being bound by three subparts of the first part of the radiating element, two longest sides of the slot being bound by first and second linear subparts, the first subpart being directly connected to the feed tab and first shorting tab, said feed tab and first shorting tab being parallel and close to the other and connected to the first subpart at a chosen place located at a chosen distance away from said slot opened end to define a chosen input impedance, and a second part being free of any slot extending approximately perpendicularly from said first part to be located in a second plane facing and approximately parallel to said ground plane.

2. The planar antenna assembly according to claim 1, wherein the chosen place is located approximately equidistant from said opened and closed ends.

3. The planar antenna assembly according to claim 1, further comprising a switching circuit mounted on said printed circuit board, the switching circuit connected to said first part, at the level of said slot opened end, through an auxiliary tab, and arranged to be placed in a chosen one of at least two different states allowing respectively radio communications in at least two different operating frequency bands.

4. The planar antenna assembly according to claim 3, wherein said switching circuit comprises MEMS devices.

5. The planar antenna assembly according to claim 3, further comprising a second shorting tab parallel to said auxiliary tab and connected to said first part and to said ground plane at the level of said slot opened end.

6. The planar antenna assembly according to claim 1, wherein said feeding circuit comprises MEMS devices.

7. The planar antenna assembly according to claim 1, wherein said slot has a rectangular shape.

8. The planar antenna assembly according to claim 1, wherein the planar antenna assembly defines a planar inverted antenna assembly.

9. Radio frequency communication equipment comprising:

a radio frequency communication module; and a planar antenna assembly connected to the communication module, the planar antenna assembly comprising:

a ground plane and a feeding circuit defined onto a face of a printed circuit board, a feed tab and a first shorting tab respectively coupled to said feeding circuit and said ground plane, and a radiating element connected to said feed tab and first shorting tab and in which a slot, including opened and closed ends, is defined, wherein said radiating element includes a first part now located in a first plane approximately perpendicular to said ground plane and in which said slot is defined, the slot being bound by three subparts of the first part of the radiating element, two longest sides of the slot being bound by first and second linear subparts, the first subpart being directly connected to the feed tab and first shorting tab, said feed tab and first shorting tab being parallel and close to the other and connected to the first subpart at a chosen place located at a chosen distance away from said slot opened end to define a chosen input impedance, and a second part being free of any slot extending approximately perpendicularly from said first part to be located in a second plane facing and approximately parallel to said ground plane.

10. The radio frequency communication equipment according to claim 9, wherein the chosen place is located approximately equidistant from said opened and closed ends.

11. The radio frequency communication equipment according to claim 9, wherein the planar antenna assembly further comprises a switching circuit mounted on said printed circuit board, the switching circuit connected to said first part, at the level of said slot opened end, through an auxiliary tab, and arranged to be placed in a chosen one of at least two different states allowing respectively radio communications in at least two different operating frequency bands.

12. The radio frequency communication equipment according to claim 11, wherein said switching circuit comprises MEMS devices.

13. The radio frequency communication equipment according to claim 11, wherein the planar antenna assembly further comprises a second shorting tab parallel to said auxiliary tab and connected to said first part and to said ground plane at the level of said slot opened end.

14. The radio frequency communication equipment according to claim 9, wherein said feeding circuit comprises MEMS devices.

15. The radio frequency communication equipment according to claim 9, wherein said slot has a rectangular shape.

16. The radio frequency communication equipment according to claim 9, wherein the planar antenna assembly defines a planar inverted antenna assembly.

17. The radio frequency communication equipment according to claim 9, further comprising a casing housing the radiofrequency communication module and the planar antenna assembly.

18. The radio frequency communication equipment according to claim 9, wherein the radio frequency communication equipment comprises a mobile phone.

19. The radio frequency communication equipment according to claim 9, wherein the radio frequency communication equipment comprises a base station.

* * * * *